United States Patent [19]

Maksymiak

[11] 3,984,183

[45] Oct. 5, 1976

[54] SHEET STRIPPING FROM IMAGING SURFACE

[75] Inventor: John Maksymiak, Penfield, N.Y.

[73] Assignee: Xerox Corporation, Stamford, Conn.

[22] Filed: Feb. 24, 1975

[21] Appl. No.: 552,072

[52] U.S. Cl. ..... 355/16; 271/188; 271/DIG. 2; 355/3 R

[51] Int. Cl.² ..... G03G 15/00

[58] Field of Search ..... 271/188, 209, DIG. 2; 355/3 BE, 3 DR, 16; 226/93-96

[56] References Cited

UNITED STATES PATENTS

| | | | |
|---|---|---|---|
| 3,536,397 | 10/1970 | Van Wagner | 355/3 DR |
| 3,749,398 | 7/1973 | Fujita et al. | 271/188 X |
| 3,884,623 | 5/1975 | Slack | 219/216 |
| 3,912,256 | 10/1975 | Nagahara | 271/DIG. 2 |

*Primary Examiner*—Joseph F. Peters, Jr.
*Assistant Examiner*—Kenneth C. Hutchison

[57] ABSTRACT

The self-stripping action of a copy sheet from an imaging suface after transfer in electrostatographic copying is substantially increased by slightly curving the imaging surface transverse their mutual direction of movement to provide a slight corresponding crown in the copy sheet on the imaging surface at the stripping area where the imaging surface is curved away from the path of the copy sheet in their direction of movement. Examples of the imaging surface are a substantially cylindrical photoreceptor surface with a uniform slight continuous crown, or a flexible belt slightly deformed over a crowned support roller.

21 Claims, 4 Drawing Figures

SHEET STRIPPING FROM IMAGING SURFACE

The present invention relates to electrostatographic copying, and in particular to an apparatus and method for improved stripping of copy sheets from an imaging surface.

The accurate and reliable transport of copy sheets, particularly cut paper, through the several work stations of electrostatographic copying systems is a well known problem particularly due to the highly variable nature of such materials. Paper jams are one of the main causes of copying machine shutdowns. Various sheet transporting devices are well known, such as mechanical grippers, vacuum and other transport belts, feed rollers, wire guides, charged photoreceptors, etc.. Generally several different transport systems are utilized, and the sheets must be transferred between transport systems. Each such sheet transport transfer adds a potential jam area, especially if the sheet has a pre-set curl. It is known that xerographic copy sheet beam strength can be increased by forming undulations therein, e.g., U.S. Pat. No. 3,845,742, issued Nov. 5, 1974, to R. R. Thettu. Sheet bowing to facilitate feeding is known, e.g., U.S. Pat. Nos. 3,687,448; 3,658,323; and 2,991,075. A curved edge sheet guide plate before image transfer is disclosed in U.S. Pat. No. 3,820,889 to H. Nitanda et al.

The image transfer work station has a particular sheet handling problem because of electrical and pressure effects on the sheet, and severe limitations on the type of sheet handling which can be utilized without damaging the imaging surface, or affecting transfer process by disturbing the image before or after transfer. In the transfer station the copy sheet must be maintained in accurate registration with the toner image to be transferred. The transfer electrostatic fields and transfer contact pressure are critical for good transferred image quality. Further, the sheet typically acquires a tacking charge and the imaging surface has a charge on it as well. An uneven or non-uniform charge on the copy sheet or its transport as the sheet passes through the transfer station can cause transfer defects observable on the final copy.

In a conventional transfer station in electrostatography, and in particular xerography, a previously developed image of toner (image developer material) is transferred from the photoreceptor (the original support and imaging surface) to the copy sheet (the final support surface or transfer member). The toner thus transferred may then be fixed to the copy sheet, typically in a subsequent thermal fusing station.

In xerography, this image transfer is most commonly achieved by electrostatic force fields created by D.C. charges applied to or adjacent the back of the copy sheet while the front side of the copy sheet contacts the toner bearing photoreceptor surface. The transfer fields must be sufficient to overcome the forces holding the toner onto the photoreceptor and to attract the toner over onto the copy sheet. These transfer fields are generally provided on one of two ways: by ion emission of D.C. charges from a transfer corotron deposited onto the back of the copy paper, as in U.S. Pat. No. 2,807,233; or by a D.C. biased transfer roller or belt rolling along the back of the paper, and holding it against the photoreceptor. In either case the copy sheet must be held in registration with, and moved together with, the imaging surface in order to transfer a registered and unsmeared image. In the case of transfer accomplished by D.C. charges applied to the back of the copy sheet, these charges provide a substantial "tacking" force which electrostatically holds the copy sheet against the imaging surface.

A particularly difficult problem in modern xerographic systems is the reliable and consistent stripping of the copy sheet off of the imaging surface after the transfer of the image has been accomplished. Due to practical space and time constraints, this must generally be done as closely as possible after the transfer step, yet without disturbing the transferred toner image on the copy sheet. This image is readily disturbed by either mechanical or electrostatic forces since it is generally unfused at this point. Yet in order to separate the copy sheet from the photoreceptor, the electrostatic tacking bond and other forces therebetween must be overcome. Various stripping systems have been utilized in the prior art. One such system is an air puffer applying a jet of air towards the lead edge of the copy sheet to initiate its separation from the imaging surface, as described, for example, in U.S. Pat. No. 3,062,536 to J. Rutkus, Jr., et al. Other mechanical stripping systems use stripping fingers for catching the lead edge of the copy sheet. These systems can cause image disruptions under certain circumstances, and stripping fingers can scratch or rub against the imaging surface or mis-strip if they are not maintained carefully positioned closely away from the imaging surface. An example of such mechanical stripping system is disclosed in U.S. Pat. No. 3,578,859 to W. K. Stillings. This patent also discloses an example of a vacuum transport system closely adjacent the photoreceptor and forming a part of the stripping system after stripping of the lead edge has been initiated.

A preferred stripping system is one which does not require such pneumatic or other mechanical stripping devices at all, or uses them only as a "back-up" system for stripping certain occasional sheets whose weight, humidity, curl, or other condition renders them particularly difficult to strip from the imaging surface. Such non-mechanical stripping systems utilize the self-stripping tendency of the copy sheet to continue along a linear path when the imaging surface curves away from this path at the stripping area. The property of the copy sheet providing such self-stripping action is generally referred to as its "beam strength," or "stiffness," which is proportional to its cross-sectional moment of inertia. However, if the sheet is maintained planar at the stripping point its moment of inertia can be increased only by changing its thickness or material characteristics.

The ability of the copy sheet to self-detack is a function of the sheet stiffness, its tacking charge, and the photoreceptor radius. The effectiveness of the self-stripping action is increased by increasing the curvature of the imaging surface (in the direction of the imaging surface). However, this is limited by practical considerations. For example, if the imaging surface is a cylindrical drum, this curvature is controlled by the drum radius, which must be large enough to accommodate the various processing stations on the imaging surface. Where the imaging surface is a photoreceptor belt, a portion of it may be more sharply arcuately deformed (curved) in the stripping area, but it will be subject to practical limitations of flexure strength, surface wave formations, etc., of the photoreceptor material in many cases, particularly for an inorganic photoreceptor.

This self-stripping action of the copy sheet can be made possible even where the transfer process creates strong electrostatic tacking forces by providing a detacking corona charge generator to neutralize these tacking charges after transfer, as disclosed in U.S. Pat. application Ser. No. 433,971, filed 1/15/74, by Norbett H. Kaupp, originally filed Oct. 11, 1966, now U.S. Pat. No. 3,870,515, and also in U.S. Pat. No. 3,357,400 issued Dec. 12, 1967, to A. T. Manghirmalani.

It may be seen that a Japanese patent application No. 6063/1972, filed June 16, 1972, and laid open as a publication No. 22141/1974 on Feb. 27, 1974, by Yasumori Nagahara (Ricoh K. K.) discloses forcing a copy sheet and a photosensitive sheet in contact therewith into recesses where both are deformed for their separation by plural external pressure means in localized dimpling areas.

The present invention is intended to improve the self-stripping action of copy sheets from an imaging surface and to provide such self-stripping improvement without a corresponding increase being required in the curvature of the imaging surface in its direction of movement. A slight transverse curvature or crown in the imaging surface at the stripping area imparts a corresponding slight crown to the copy sheet thereon for substantially increasing the cross-sectional moment of inertia and self-stripping action of the copy sheet from the imaging surface, without introducing any image disturbance. Conventional types of transfer and image forming systems can be utilized, and relatively thinner sheets can be self-stripped from an otherwise unchanged copying system.

The stripping system of the invention overcomes many of the above-discussed problems with a very simple and inexpensive modification of conventional imaging surface supports or substrates configurations. It may be utilized for stripping copy sheets from an imaging surface of any desired orientation or configuration, including both cylindrical and belt imaging surfaces, and for duplex as well as simplex transfer systems. The terms "copy" and "copy sheet" stripping as referred to herein will be understood to include the lead edges of uncut webs as well as cut sheets, etc., and various imaging materials other than paper.

The above-cited and other references teach details of various suitable exemplary xerographic structures, materials, systems and functions known to those skilled in the art, and thus are incorporated by reference in this specification, where appropriate.

Further objects, features and advantages of the invention pertain to the particular apparatus, steps and details whereby the above-mentioned aspects of the invention are attained. Accordingly, the invention will be better understood by reference to the following description of examples thereof, and to the drawings forming a part thereof wherein.

Figure 1:
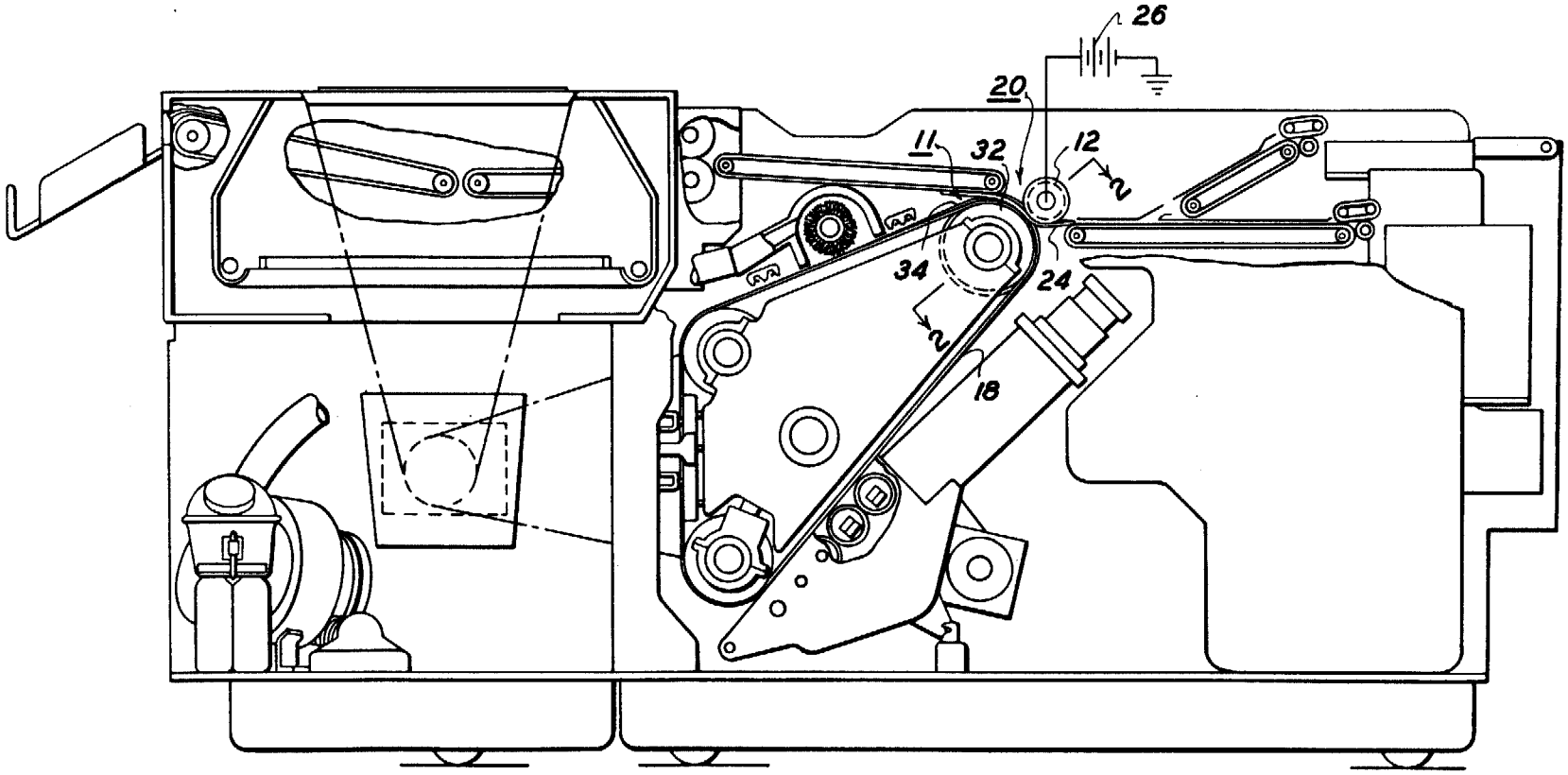
FIG. 1 is a first exemplary embodiment of the invention illustrating a transfer and stripping station in accordance with the present invention in an otherwise known xerographic apparatus.
Figure 2:
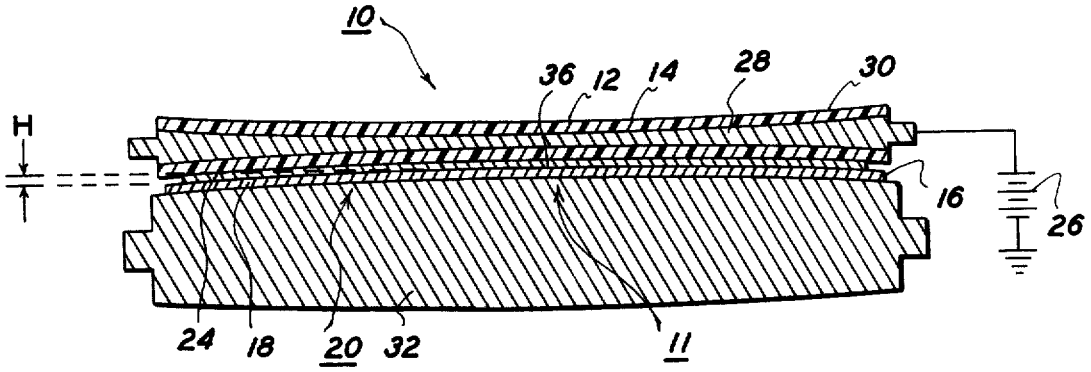
FIG. 2 is a cross-sectional view taken along the line 2—2 of the transfer and stripping station of FIG. 1.

Referring first to FIGS. 1 and 2, there is shown therein an exemplary and otherwise known electrostatographic copying system 10 having a generally cylindrical transfer roller member 12 and a copy sheet stripping station 11 which is an example of the present invention. The substantially cylindrical outer surface 14 of the transfer member 12 is urged towards the curved imaging surface 16 of an endless belt photoreceptor 18 to define a transfer nip 20. Toner particles are transferred from the imaging surface 16 to the facing surface of a conventional copy sheet 24 as it is passed through the transfer nip 20. The copy sheet 24 then self-strips from the arcuately deflected photoreceptor 18 and continues on via a transport belt to fusing rolls. The copy sheet 24 is held uniformly against the imaging surface 16 by the transfer member 12 and the transfer is accomplished by electrical transfer fields generated between the transfer member 12 and the imaging surface 16 in a known manner. Here these transfer fields are generated by applying an electrical bias from a bias voltage source 26 to a conductive core 28 of the transfer member 12, and by providing a grounded substrate for the photoreceptor 18. An image-wise pattern of the toner is formed on the imaging surface 16 by suitable conventional electrostatographic processes prior to its entry into the transfer station.

The exemplary bias transfer roller 12 here comprises the conductive core 28 covered with a homogeneous and substantially uniform layer 30 of resilient material providing the exterior surface 14 of the roller. This material layer 30 may be electrically semi-conductive or relaxable as described in U.S. Pat. Nos. 3,781,105 or 3,702,482 or disclosed in the transfer roller of the Xerox "9200" high speed commercial xerographic duplicator.

The transfer roller 12 extends in length along the roller axis by a distance which is slightly greater than the predetermined maximum lateral dimension of any copy sheet 24 to be utilized for copying herein. The photoreceptor 18 is preferably slightly wider than both the roller 12 length and the copy sheet 24 lateral dimension, i.e., the transverse dimensions of the imaging surface can be approximately that of the copy sheet. It will be appreciated that this maximum lateral dimension of the copy sheet will depend on whether the copy sheets are being fed long edge first or short edge first (sideways or endwise) through the transfer nip 20.

In the combined transfer station and stripping station 11 of FIGS. 1 and 2, the imaging surface 16 configuration is formed by conformingly running the belt photoreceptor 18 over a support roller 32. The support roller 32 here is a conductive metal roller having a generally cylindrical, but slightly crowned, exterior surface. The support roller 32 here is very slightly convex, and uniformly so, so that in cross-section it is circular at any plane transverse its axis of rotation. The uniform radius at its center is only slightly larger than its uniform radius at its ends to provide the crown height H.

It may be seen that the belt photoreceptor 18 partially wraps around the outer surface of the support roller 32 and is sufficiently flexible or deformable to conform to the portion of the support roller 32 over which it runs. Since the photoreceptor 18 is here of a uniform thickness the imaging surface 16 thereby is curved to conform to the same curvature as the support roller 32 in this area. Likewise, since the copy sheet 24 must uniformly lie against the imaging surface 16 in the transfer nip 20, the copy sheet 24 configuration and curvature is also controlled by and conforms to the surface of the support roller 32.

As will be further discussed herein, the curvatures of these surfaces transverse the direction of the movement of the imaging surface 16, and the copy sheet 24 thereon, have been greatly exaggerated in all of the Figures here in order to more clearly illustrate the invention. Actually, these transverse curvatures and crowns, if drawn to scale in the preferred dimensions disclosed herein, would be invisible in these Figures. That is, if FIGS. 1 and 2 were drawn to scale the support roller 32 and transfer roller 12 would appear here as purely cylindrical and the photoreceptor belt 18 and copy sheet 24 would appear linear in cross-section. Likewise, in FIG. 3 the preferred imaging surface would appear to scale as a purely cylindrical drum, and the copy sheet therein would also appear linear in cross-section.

Referring to FIG. 2 and the biased transfer roller 12, the exterior surface 14 thereof is generally cylindrical, but has a slight non-cylindrical crown therein which corresponds to, but is opposite from, the transerse crown in the imaging surface 16, so as to provide uniform conformation of the transfer roller surface 14 with the imaging surface 16 in the transfer station. That is, the roller surface 14 is oppositely curved from the imaging surface 16 in the transfer nip 20 so as to provide uniform pressure engagement therewith.

It will be appreciated that the transfer roller 12 could be replaced by a transfer belt which would automatically conform to this imaging surface 16 curvature. Alternatively, the transfer roller 12 could be replaced by a conventional transfer corona generator applying transfer charges directly to the back of the copy sheet 24 in the transfer area. As another alternative the transfer could be accomplished upstream of the stripping area and the belt 18 held flat in the transfer area. This, however, would require the copy sheet to remain on the belt for a much longer path length.

It will be appreciated that in the transfer station of FIGS. 1 and 2, that the photoreceptor 18 providing the imaging surface 16 and the copy sheet 24 thereon are moving together in the same direction of movement. In FIG. 1 this is from right to left through the transfer nip 20, and in FIG. 2 this is directly toward the observer. In this movement direction the imaging surface 16 has a first curvature 34, defined by the generally cylindrical curvature of the supporting roller 32 about its axis. This first curvature 34, as may be seen from FIG. 1, causes the imaging surface 16 to curve away from the linear extension of the path of the copy sheet 24, and therefore provides self-stripping of the copy sheet from the imaging surface due to the stiffness or beam strength of the copy sheet 24 resisting its following this first curvature of the imaging surface 16, as is known. However, there is provided here a second, additional, and superimposed curvature 36 at the stripping area 11. This second and much smaller curvature 36, as previously discussed, is transverse the movement direction of the imaging surface and copy sheet, (i.e., in the plane of FIG. 2) and thereby also transverse the above-described first curvature 34 of the imaging surface. The second curvature 36 substantially increases the cross-sectional moment of inertia of the copy sheet 24, its stiffness, and therefore its reliability of stripping from the imaging surface by a self-stripping beam strength action. This transverse second curvature 36 of the imaging surface 16 has a crown height H illustrated in FIG. 2 between its highest and lowest points. This crown height here corresponds to the difference between the maximum radius and the minimum radius of the imaging surface 16 about the axis of the support roller 32 which forms it.

As previously noted, the first curvature 34 in the direction of motion of the imaging surface 16 is circular, although having different radii with maximum and minimum radii corresponding to the crown height H. The second and transverse curvature 36 here is also desirably, although not necessarily, circular. However, this second curvature 36 has a minimum curvature radii which is much greater than the maximum curvature radii of the first curvature 34. That is, the second curvature 36 is preferably a single, continuous and very slight curve which curves smoothly across the imaging surface 16 with a very large radius at all times.

This use of a single continuous curve 36 extending substantially across the entire transfer width of the imaging surface 16 is preferable for several reasons. With such a configuration the greatest crown height H and, therefore, the maximum sheet stiffness, is obtained for the minimum degree of imaging surface curvature, and therefore the minimum strain or deformation of the photoreceptor belt 18. Other non-cylindrical variations, such as localized deformations in the belt 18, substantially increase the amount of belt strain for a given crown height, but also can create difficulties in obtaining proper conformity of the copy sheet to the imaging surface in the transfer area and also difficulties in obtaining uniform pressure engagement of the transfer roller 12. However, other large radius transverse second curvatures of the imaging surface could be utilized in certain circumstances.

For the above-noted and other reasons, it is desirable to keep the maximum crown height H (and corresponding maximum transverse deformation of the photoreceptor belt 18) as small as possible. By the present invention, it has been determined that this maximum crown height can be kept very small in comparison to other system dimensions and still provide large increases in the cross sectional moment of inertia and stiffening of copy sheets conforming to this crown.

Specifically, it has been found that more than an order of magnitude increase in the theoretical sheet stiffness of copy sheets of conventional thickness can be provided with a maximum crown height of less than 1/100 of the transverse dimension of the imaging surface 16 (the maximum width of the surface forming the crown height). A suitable crown height is only approximately 1/500 the transverse dimension of the imaging surface 16. As noted above, the second curavture 36 required to produce this slight crown height is so small, and has such a large radius, as to be invisible in drawings of the approximate scale provided here, where they must be exaggerated highly for visibility.

By way of examples, for both embodiments herein, it has been calculated that a crown of only 0.025 inches (0.064 centimeters) in a ten inch (26.4 centimeters) transverse extent of a conventional copy sheet which is 0.004 inches (0.011 centimeters) thick [i.e., "20 pound" paper] will increase the moment of inertial or stiffness of that copy sheet by almost 40 times. For thinner 0.002 inch (0.0051 centimeters) conventional copy sheets [i.e., approximately "13 pound" paper] this same crown height will increase the copy sheet thickness by approximately 170 times. Therefore, it has also been calculated that the threshold maximum imaging surface radius in the direction of its motion (the first curvature 34 here) which will self-strip a copy sheet with a transfer electrostatic tacking charge thereon causing a field of 10 volts per micron, for a 0.011 centiimeter thick copy sheet, can be increased from 0.39 inches (0.96 centimeters) to 5.1 inches (13 centimeters) by the above crown of only 0.025 inches (0.064 centimeters). Alternatively, it has been calculated that for a basically constant imaging surface stripping radius (first curvature 34) of 2.5 inches (6.4 centimeters) that the threshold of the maximum transfer charges which can be left on the copy sheet and still allow self-stripping can be increased from a field of 3.3. volts per micron up to a much more desirable 20.7 volts per micron for this same crown and the exemplary 0.025 inch (0.064 centimeter) paper. For the same stripping radius and transverse crown the transfer field can be increased from 1.16 volts per micron to 15 volts per micron for the thinner paper of 0.002 inches (0.0051 centimeters) thickness. Theoretically these higher transfer fields can provide efficient transfer without requiring transfer charge neutralizing by a detacking corona generator.

It will be appreciated that even the small preferred transverse crown disclosed herein, (particularly since it produces a compound curved surface) can cause excessive strain for certain types of photoreceptor belt materials in combination with smaller stripping radii, particularly for inorganic photoconductors such as selenium and selenium alloys. Thus, an organic photoconductive material having a certain amount of elasticity is preferred.

It will be appreciated that certain other strain reducing techniques can be utilized in addition to the use of a single large radius crown forming curvature as discussed above. Specifically, other support rollers for the belt 12 can be correspondingly, but oppositely, crowned to maintain a more uniform tension across the belt. This can also be used to prevent waveness or irregularities in the belt at any critical point thereon. For example, a slightly convex support roller 32 could be followed by a correspondingly slightly convex support acting against the other side of the belt. Alternatively, all of the rollers could be crowned in the same degree and direction, and the belt itself then could be constructed with a crowned configuration, slightly longer in the center than at its edges. This could be accomplished by preforming the belt substrate into this configuration before the photoconductive material is applied thereto. Such a belt maintained with the same crown over its entire length would present problems of focusing an optical image thereon and developing it, etc., if the crown were substantial. However, with the preferred crown heights specified herein, the entire imaging surface can be maintained within the depth of focus of conventional optics for forming an image thereon. Likewise, other xerographic processing stations for such a fully crowned belt could remain conventional, or only require slight adjustments, since such a slightly crowned surface can be treated as essentially linear for their purposes. Such a fully crowned belt would thus be similar in its operations to the embodiment of FIGS. 3 and 4 wherein the imaging surface is a uniformly and continuously slightly crowned cylindrical drum rather than a belt.

Figure 3:
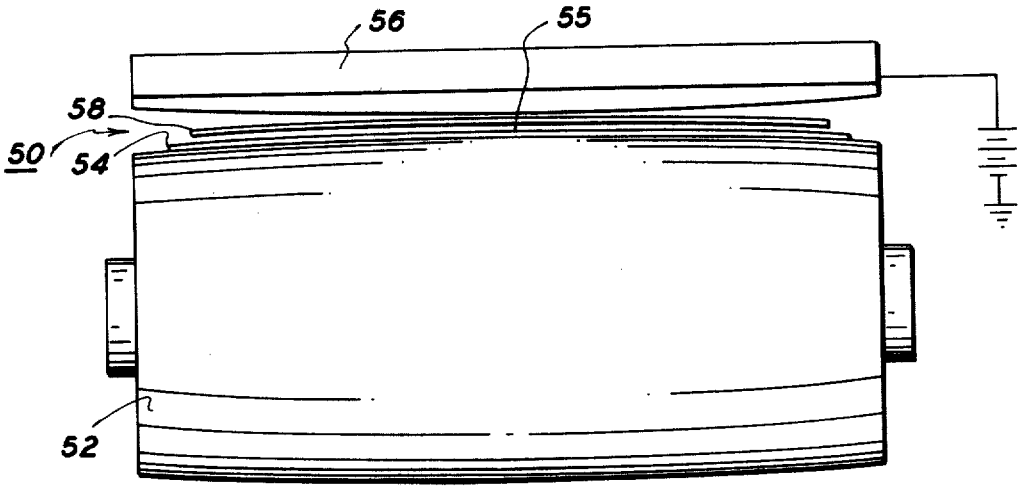
FIG. 3 is a second embodiment of the present invention where the imaging surface is a drum rather than a belt, in a side view.
Figure 4:
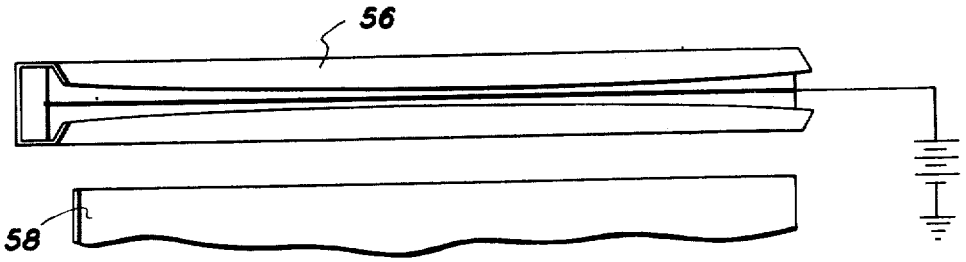
FIG. 4 is a bottom view of the transfer corona generator and sheet guide of FIG. 3.

Referring now to the embodiment of FIGS. 3 and 4, there is shown in FIG. 3 an otherwise conventional xerographic copying system 50 having an otherwise conventional generally cylindrical drurm 52 of conductive metal and surfaced with a layer of photoconductive material such as selenium alloy. The drum 52 differs from a conventional xerographic drum in that it has a single, smooth, large radius of curvature 55 crown transverse the direction of movement of the imaging surface. The imaging surface here is the surface of the drum 52.

A copy sheet 54 is placed conventionally in uniform contact with the surface of the drum 52 at the transfer area as the drum 52 rotates about its central axis. The difference between this and a conventional transfer station is that the copy sheet 54 assumes the transversely crowned configuration of the drum 52 rather than being linear in cross-section as on a conventional xerographic drum. A generally conventional transfer corona generator 56 is spaced above the copy sheet 54 at the transfer station to apply the transfer charges to the back of the copy sheet 54 and thereby electrostatically tack the copy sheet to the surface of the drum 52. Self-stripping of the copy sheet 54 then occurs due to the combined action of the generally cylindrical (first) curvature of the drum 52 about its axis together with the copy sheet stiffness imparting action of the transverse or second curvature 55 forming a crown thereon, in the same manner as described above for the embodiment of FIGS. 1 and 2. The distinction is that in the embodiment of FIGS. 3 and 4, the crown is fixed and remains on the drum 52 uniformly around its entire circumference, whereas in the flexible belt embodiment of FIGS. 1 and 2, the imaging surface can, if desired, by crowned only at the stripping area and be held flat or cylindrical in other areas. In either embodiment the crown can be concave rather than convex. Convex is preferred, for central initial sheet contact.

As discussed above, the desired crown heights in FIG. 3 are sufficiently small so as not to interfere with conventional imaging and other processing elements used in a conventional cylindrical drum xerographic machine. A significant advantage of the embodiments of FIGS. 3 and 4 is that there is no flexure, and therefore no strain of any kind, of the imaging surface. The photoconductive surface is fixed to the inflexible metal substrate surface of the drum 52, which may be readily machined to any desired crown configuration during manufacture.

In FIGS. 3 and 4 there is shown a non-planar sheet guide 58 for engaging the copy sheet 54 prior to the entrance of the copy sheet into the transfer station, i.e., before the copy sheet 54 engages the surface of the drum 52 and passes under the corotron 56. The sheet guide 58 is here to approximately the same width and curvature as the copy sheet 54 assumes when it is uniformly tacked to the surface of the drum 52. That is, the sheet guide 58 in cross-section, as in FIG. 3, has the same curvature as the transverse or second curvature 55 of the drum 52. The sheet guide 58 encourages the pre-forming of this proper curvature to the sheet 54 lead edge before the sheet lead edge engages the imaging surface so that it will make a complete and uniform engagement therewith. The sheet guide 58 also functions to increase the stiffness of the copy sheet in its otherwise unsupported area before it engages the imaging surface. This stiffening improves the reliability of the copy sheet feeding in encouraging it to consistently and reliably engaging the same cirumferential point on the drum 52 in registration with the image thereon, especially for thin or curled sheets. This sheet guide may also be used with the embodiment of FIGS. 1 and 2.

The transfer corotron 56 here is shown with an exaggeratedly variable width shield opening. This opening is oppositely varying in relation to the transverse curvature of the drum 52 which it faces. Since the output of a corotron will vary along its length depending on the varying spacing of the corona generating wire therein from the surface to be charged, the variable shield opening compensates for this by narrowing the opening and, therefore, restricting the corona charge output, in the areas where the curvature of the drum 52 causes its surface to more closely approach the corotron 56. However, as discussed above, for the preferred very slight crown height herein, this difference in spacing would have a non-existent or negligible effect on the uniformity of the corona generator 56 output and a conventional uniform shield opening corona generator would be preferred.

In conclusion, with the present copy sheet stripping system the copy sheets may be brought into intimate contact with an area of a smooth, continuous and uninterrupted imaging surface in a manner that will not disturb the transferred image, especially where it consists of unfused toner particles. Further, the present stripping system will not damage or wear the imaging surface either by abrasion or by excessive flexing or strain (for a suitably selected imaging surface material). Dimpling, grooving, or other undesirable highly arcuate deformations or irregularities in the imaging surface are not required to achieve the desired results of a significant improvement in copy sheet beam strength at the stripping area. Neither are any external devices required to act on the imaging surface or copy sheet. The increased stripping forces are generated by the configuration of the imaging surface itself at the stripping area. In the case of a drum imaging surface as in FIGS. 3 and 4, no deflection or deformation at all of the imaging surface is required and, therefore, operation is not limited by strain properties of the materials. In the case of a belt as in FIGS. 1 and 2, the stresses can be made relatively low and relatively widely distributed rather than localized in small areas of the imaging surface. A single large crown radius as disclosed here inherently provides less strain for equivalent crown height than a plurality of smaller deformations.

The resulting increase in self-stripping force by the disclosed method and apparatus increases the range and type of sheets which can self-strip from a given imaging surface and transfer station reliably and consistently as soon as possible after transfer, or while still in the transfer station, with less sensitivity to changes in ambient conditions such as humidity.

While there has been described herein novel transfer and stripping systems and methods for electrostatographic copying providing improved sheet stripping with a simple and inexpensive arrangement, it will be appreciated that numerous modifications and variations thereof will be obvious to those skilled in the art. As examples, the transferred image could be liquid, or the imaging surface could be an intermediate web rather than a photoreceptor. The following claims are intended to cover all such variations and modifications as fall within the true spirit and scope of the invention.

What is claimed is:

1. In an electrostatographic copying apparatus, wherein an image is transferred from an imaging surface means to a copy sheet which is placed in intimate contact with said imaging surface means and moved together with said imaging surface means in a given movement direction at a transfer station, and wherein the copy sheet is then stripped from said imaging surface means at a sripping area, the improvement wherein:

said imaging surface means has a first curvature in said movement direction at said stripping area for said stripping of said copy sheet from said imaging surface means, and wherein said imaging surface means has a second curvature at said stripping area transverse said movement direction and transverse said first curvature forming a slight crown height to said imaging surface means and to said copy sheet thereon transverse said movement direction for substantially increasing the reliability of said stripping of said copy sheet from said imaging surface means.

2. The apparatus of claim 1, wherein said imaging surface means is substantially cylindrical to provide said first curvature of said imaging surface means, and wherein said second curvature is provided by a slight smooth crown on said cylindrical surface.

3. The apparatus of claim 1, wherein said imaging surface means is a slightly convex cylinder.

4. The apparatus of claim 2, wherein said imaging surface means is a slightly convex cylinder.

5. The apparatus of claim 1, wherein said imaging surface means comprises a flexible belt and wherein said first and second curvatures are both provided by running said belt over a supporting roller at said transfer station, wherein said supporting roller has a generally cylindrical surface configuration but with a smooth slightly crowned non-cylindrical curvature therein, and wherein said belt conforms to said crowned configuration of said supporting roller.

6. The apparatus of claim 5, wherein said belt comprises a flexible photoreceptor.

7. The apparatus of claim 1, wherein said transfer station includes a biased transfer roller urged against said imaging surface, and wherein said biased transfer roller has a generally cylindrical configuration but with a slight non-cylindrical crown therein corresponding to, but opposite from, said second curvature in said imaging surface means to provide uniform conformation of said bias transfer roller surface to said imaging surface means at said transfer station.

8. The apparatus of claim 5, wherein said transfer station includes a biased transfer roller urged against said imaging surface, and wherein said biased transfer roller has a generally cylindrical configuration but with a slight non-cylindrical crown therein corresponding to, but opposite from, said second curvature in said imaging surface means to provide uniform conformation of said bias transfer roller surface to said imaging surface means at said transfer station.

9. The apparatus of claim 1, wherein said first curvature is circular and said second curvature is a single continuous curve curving smoothly across said imaging surface means, and said second curvature has a minimum curvature radii which is greater than the maximum curvature radii of said first curvature.

10. The apparatus of claim 1, wherein said second curvature has a maximum crown height of less than 1/100 of the transverse dimension of said imaging surface means.

11. The apparatus of claim 1, wherein said second curvature has a crown height of approximately 1/500th of the transverse dimension of said imaging surface means.

12. The apparatus of claim 2, wherein said second curvature has a maximum crown height of less than 1/100 of the transverse dimension of said imaging surface means.

13. The apparatus of claim 1, further including non-planar sheet guide means for pre-forming a curve in said copy sheet corresponding to said second curvature prior to said copy sheet being placed in contact with said imaging surface.

14. In an electrostatographic copying apparatus, wherein an image is transferred from an imaging surface means to a copy sheet which is placed in intimate contact with said imaging surface means in a given movement direction at a transfer station, wherein said imaging surface means comprises a flexible photoreceptor belt, and wherein the copy sheet is then stripped from said imaging surface means at a stripping area where said photoreceptor belt is partially wrapped around a generally cylindrical supporting roller transverse said movement direction, the improvement wherein:

said imaging surface means has a curvature in said movement direction at said stripping area for said stripping of said copy sheet from said imaging surface means provided by said partial wrapping of said photoreceptor belt around said generally cylindrical supporting roller; and wherein said supporting roller has a generally cylindrical outer surface with the radius of said outer surface varying along the axis of rotation of said supporting roller at said stripping area.

15. In an electrostatographic copying method wherein an image is transferred from a moving flexible belt imaging surface to a copy sheet which is placed in intimate contact with said imaging surface and moved together with said imaging surface in a given movement direction, and wherein the copy sheet is then stripped from said imaging surface at a stripping area, the improvement comprising:

curving said imaging surface at said stripping area with a first curvature in said movement direction for stripping the copy sheet from said imaging surface, and simultaneously curving said imaging surface with a second curvature, supperimposed on said first curvature, transverse said movement direction and transverse said first curvature for increasing the reliability of said stripping of the copy sheet from said imaging surface, wherein said first and second curvatures are both formed by partially wrapping said belt around a supporting roller at said stripping area.

16. The method of claim 15, wherein said first curvature is circular.

17. The method of claim 16, wherein said second curvature is a single continuous curve in said imaging surface having a minimum curvature radius which is greater than the maximum curvature radius of said first curvature.

18. The method of claim 15, further including curving a copy sheet with a curve corresponding to said second curvature prior to said copy sheet being placed in contact with said imaging surface.

19. In an electrostatographic copying method wherein an image is transferred from an imaging surface to a copy sheet which is placed in intimate contact with the imaging surface and moved together with the imaging surface in a given movement direction, and wherein the copy sheet is then stripped from the imaging surface at a stripping area after the image is transferred, the improvement comprising:

curving said moving copy sheet at said stripping area with a first curvature in said movement direction for said stripping of said copy sheet from said imaging surface, and simultaneously curving said moving copy sheet with a slight second curvature, superimposed on said first curvature, transverse said movement direction and transverse said first curvature for increasing the reliability of said stripping of the copy sheet from said imaging surface.

20. The method of claim 19, wherein said first curvature of said copy sheet is produced by moving said copy sheet over a substantially cylindrical curve in said imaging surface at said stripping area, and wherein said second curvature is produced by said first curvature being curved slightly non-cylindrically.

21. The method of claim 19, wherein said copy sheet is curved in said second curvature to a crown height of less than 1/100 of the transverse dimensions of said imaging surface.

* * * * *